US009609723B2

(12) United States Patent
Feri et al.

(10) Patent No.: US 9,609,723 B2
(45) Date of Patent: Mar. 28, 2017

(54) AUTOMATIC GROUPING VIA LIGHT AND SOUND

(71) Applicant: PHILIPS LIGHTING HOLDING B.V., Eindhoven (NL)

(72) Inventors: Lorenzo Feri, Eindhoven (NL); Robert James Davies, Eindhoven (NL); Ronald Rietman, Eindhoven (NL); Willem Franke Pasveer, Dordrecht (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/765,022

(22) PCT Filed: Jan. 23, 2014

(86) PCT No.: PCT/IB2014/058485

§ 371 (c)(1),
(2) Date: Jul. 31, 2015

(87) PCT Pub. No.: WO2014/118676

PCT Pub. Date: Aug. 7, 2014

(65) Prior Publication Data

US 2015/0373812 A1 Dec. 24, 2015

Related U.S. Application Data

(60) Provisional application No. 61/759,447, filed on Feb. 1, 2013.

(51) Int. Cl.
*H05B 33/08* (2006.01)
*H05B 37/02* (2006.01)

(52) U.S. Cl.
CPC ..... *H05B 37/0236* (2013.01); *H05B 37/0245* (2013.01)

(58) Field of Classification Search
None
See application file for complete search history.

(56) References Cited

U.S. PATENT DOCUMENTS

2007/0160373 A1* 7/2007 Biegelsen ..... H05B 37/0272 398/118
2008/0258646 A1 10/2008 Beij et al.
(Continued)

FOREIGN PATENT DOCUMENTS

JP 2002299071 A 10/2002
JP 2008533660 A 8/2008
(Continued)

*Primary Examiner* — Dedei K Hammond
(74) *Attorney, Agent, or Firm* — Meenakshy Chakravorty

(57) ABSTRACT

The invention relates to a method for automatic grouping of light sources within an illumination system. The method is performed starting from a first light source of the illumination system emitting a first light signal and a first sound signal. The method includes steps of using an intensity of the first light signal as received by a second light source and an intensity of the first sound signal as received by the second light source to determine a value of a grouping function (410, 420), and assigning the first light source and the second light source to the same group of light sources when the determined value of the grouping function satisfies one or more pre-determined conditions (430, 440, 450). In this manner, a determination could be made whether or not the first and second light sources should be assigned to the same group in a manner that yields improved results over the prior art solutions.

15 Claims, 3 Drawing Sheets

(56) References Cited

U.S. PATENT DOCUMENTS

| | | | | |
|---|---|---|---|---|
| 2011/0031897 | A1 | 2/2011 | Henig | |
| 2011/0122796 | A1 | 5/2011 | Simons et al. | |
| 2011/0169413 | A1 | 7/2011 | Wendt et al. | |
| 2011/0310621 | A1 | 12/2011 | Van Der Stok | |
| 2014/0022917 | A1* | 1/2014 | Apte | G01S 1/68 370/252 |

FOREIGN PATENT DOCUMENTS

| | | | |
|---|---|---|---|
| JP | 2008537307 | A | 9/2008 |
| JP | 2008537855 | A | 9/2008 |

* cited by examiner

AUTOMATIC GROUPING VIA LIGHT AND SOUND

CROSS-REFERENCE TO PRIOR APPLICATIONS

This application is the U.S. National Phase application under 35 U.S.C. §371 of International Application No. PCT/IB2014/058485, filed on Jan. 23, 2014, which claims the benefit of U.S. Provisional Patent Application No. 61/759,447, filed on Feb. 1, 2013. These applications are hereby incorporated by reference herein.

FIELD OF THE INVENTION

Embodiments of the present invention relate generally to the field of illumination systems, and, more specifically, to systems and methods for automatic grouping of multiple light sources within such illumination systems.

DESCRIPTION OF THE RELATED ART

Commissioning is a key activity in the deployment of current lighting systems. In short, commissioning refers to the process of configuring a lighting system that takes place after the components of the system, such as e.g. light sources, sensors and wall switches, are installed in a structure and connected to power and, if necessary, to a data network. During this process, light sources that are to be controlled together are grouped and assigned to appropriate sensors and wall switches. Typically a lighting group is identified as all the light sources, and possibly also the associated sensors and switches, within a room. Often times, this grouping and assignment is done manually, e.g. by a commissioning technician.

In large lighting systems, commissioning can be a lengthy process. Therefore, there is a great interest in systems that can assist or even complete at least a part of the process automatically. Since modern lighting systems are often interconnected via wired or radio-based wireless networking technologies, in principle, this backbone network can be used to help with the commissioning process. However, a significant drawback of such networking technologies is that they cannot reliably group light sources according to their physical location, i.e. light sources in one room forming one group while light sources in another room forming another group, because walls do not pose a significant obstacle to network signals. Alternative solutions could rely on the use of light measurements to identify the light sources present. Given that light is readily blocked by many materials used for construction and decoration of internal walls, such solutions could provide a more reliable means for identifying light sources within a room. However, nowadays many rooms have glass walls. Since visible light is not blocked by glass, light-based solutions for grouping light sources can become inadequate as well.

What is needed in the art is a technique for automatic grouping of light sources of an illumination system in a manner that improves on at least some of the problems described above.

SUMMARY OF THE INVENTION

One object of the invention is to provide a system and method that allow automatic grouping of light sources in a room or a sub-section of a room.

The proposed method is applicable to illumination systems comprising at least a first light source and a second light source and takes place following the first light source emitting a first light signal and a first sound signal. The method includes steps of using an intensity of the first light signal as received by a second light source and an intensity of the first sound signal as received by the second light source to determining a value of a grouping function, and assigning the first light source and the second light source to the same group of light sources when the determined value of the grouping function satisfies a pre-determined condition.

As used herein, the term "light signal" refers to an optical wave of any frequency, such as e.g. visible light, infrared (IR), or ultraviolet, even though in practice visible or IR light is envisioned to be the most used. As used herein, the term "sound signal" refers to an acoustic wave of any frequency, even though in practice ultrasound is envisioned to be the most used. Finally, the term "grouping function" in the present context is used to describe any function that takes as inputs at least the intensities of the light and the sound signals emitted by the first light source as measured by the second light source (further inputs are possible) and produces as an output one or more numeric values which may be evaluated against certain pre-determined conditions providing an indication whether or not the first and second light sources should be assigned to the same group.

Embodiments of the present invention are based on several realizations. First of all, they are based on the realization that sound can be used for grouping of light sources. Because sound signals are attenuated by glass, the problem of a glass wall described in the background section of the present application could be overcome with sound-based grouping. Embodiments of the present invention are further based on recognition that grouping based on the use of sound alone would be prone to other problems. For example, in situations where the rooms are separated by mobile office partitions that do not extend all the way up to the ceiling, as if e.g. done in so-called "cubicle" office spaces, sound would be attenuated significantly less, leading to problems with correct grouping of light sources. Embodiments described herein advantageously utilize both light and sound measurements in order to group light sources, where the positive aspects of both solutions are exploited and used to complement one another. Comparing the intensities of the light and sound signals emitted by a first light source to one another, as detected by a second light source, by a way of using an appropriate function, referred to herein as a "grouping function", allows assessing whether the first and second light sources are physically located within the same room as well as making conclusions regarding the proximity of the first and second light sources. Consequently, a determination could be made whether or not the first and second light sources should be assigned to the same group in a manner that yields improved results over the prior art solutions. An additional advantage of such a solution is that it would require very little investment in upgrading the light sources in use now days because such light sources are already typically equipped not only with light receivers and transmitters but also with sound receivers and transmitters used for sunlight integration and presence detection.

In one embodiment, the grouping function may be dependent on a ratio between the intensity of the first light signal as received by the second light source and the intensity of the first sound signal as received by the second light source, or a derivative thereof, and the pre-determined condition for grouping could then comprise that the determined ratio is within a pre-determined range.

In another embodiment, the grouping function may be dependent on a difference between the intensity of the first light signal as received by the second light source and the intensity of the first sound signal as received by the second light source, or a derivative thereof. In such an embodiment, the method may further comprise obtaining an intensity of the first light signal as emitted by the first light source and an intensity of the first sound signal as emitted by the first sound source, determining a path loss of the first light signal as the difference between the intensity of the first light signal as emitted by the first light source and the intensity of the first light signal as received by the second light source, determining a path loss of the first sound signal as the difference between the intensity of the first sound signal as emitted by the first sound source and the intensity of the first sound signal as received by the second light source, and determining the value of the grouping function as the difference between the path loss of the first light signal and the path loss of the first sound signal, wherein the one or more predetermined conditions comprises the difference between the path loss of the first light signal and the path loss of the first sound signal being within a predetermined range.

In an embodiment, the method further includes the step of determining a difference between the time when the first light signal is received by the second light source and the time when the first sound signal is received by the second light source. A difference between the time of receipt of one signal and the time of receipt of another signal is sometimes referred to as a "time of flight" (TOF). In this case, the TOF refers to the time delay between receipt of a light signal emitted by one light source and a sound signal emitted by the same light source. This embodiment is based on the recognition that the specific combination of light and sound measurements, as opposed to a combination of any other communication means, can obtain very accurate measurements of the TOF because due to the vastly different speeds of light and sound it is possible to accurately measure the time delay of the sound signal in comparison with the light signal.

To make sense of the determined TOF, the device processing the measured time difference needs to have knowledge of the time difference in when the light and sound signals were emitted by the emitting light source. For example, the processing device could be provided with information that the light sources are configured to emit the light and sound signals simultaneously or with a certain pre-determined delay between the emission of the light signal and the emission of the sound signal. Once that is known, the TOF allows making various conclusions based on how long it takes a signal to travel a certain distance through a medium.

For example, in one further embodiment, the first light source and the second light source may be assigned to the same group of light sources not only when the ratio between the received intensities of the light and sound signals is within the pre-determined range, but also when the determined difference between the time when the light signal is received and the time when the associated sound signal is received is below a pre-determined value. Such an embodiment allows using the TOF of the first sound signal, measured against the first light signal, as a further criterion for assigning the first and second light sources to the same group. In this manner, it is possible to differentiate between a group of light sources clustered in one area of a single room and a group of light sources in another area of the same room. This embodiment may be particular beneficial for large rooms, such as e.g. presentation auditoriums, where the first and second light sources would be assigned to the same group when the distance between them is relatively small (e.g. both light sources are in the front of the auditorium), but would not be assigned to the same group when the distance between them is relatively large (e.g. one light source is in the front of the auditorium while the other one is in the back of the auditorium).

In another further embodiment, the TOF may be used to normalize the detected intensity values. Namely, the intensity of the first light signal as received by the second light source and the intensity of the first sound signal as received by the second light source may be normalized to the determined difference between the time when the first light signal is received and the time when the associated sound signal is received, e.g. prior to determining the ratio between the intensities or prior to comparing the received intensities to some threshold values in order to make the grouping decision. This embodiment allows taking proper account of the possible different rates of decrease in the strengths of light and sound signals as a function of the distance travelled by the signals.

In an alternative embodiment, the intensity of the first light signal as received by the second light source could be normalized to an intensity of the first light signal as emitted by the first light source and the intensity of the first sound signal as received by the second light source could be normalized to an intensity of the first sound signal as emitted by the first light source, e.g. prior to determining the ratio. This embodiment provides a manner alternative to that of using TOF for taking proper account of the possible different rates of decrease in the strengths of light and sound signals as a function of the distance travelled by the signals. In one embodiment, the intensities of the first light and sound signals as emitted by the first light source may be pre-programmed (i.e., known ahead of time) to the device carrying out the present methods. Alternatively, the emitting intensities may be encoded into one or both of the first light and sound signals in any of the manners known in the art. For example, the emitting intensities of both first light and sound signals may be encoded into the first light signal using a so-called coded light (CL) technique.

In an embodiment, the first light source and the second light source may be assigned to the same group of light sources based on additional information. Such an embodiment allows using additional information related e.g. to location of windows or projectors in a room, or any other information that may be useful in making the decision on whether or not the first and second light sources should be assigned to the same group. Such additional information may either be provided to the device carrying out the present methods as a part of the commissioning/grouping procedure or pre-stored in the device.

In an embodiment, the method may further comprise establishing that the first light source and the second light source should not be assigned to the same group of light sources when the intensity of the first light signal as received by the second light source is below a predetermined light intensity value and/or when the intensity of the first sound signal as received by the second light source is below a predetermined sound intensity value.

In an embodiment, the method may further comprise obtaining an intensity of the first light signal as received by a third light source and an intensity of the first sound signal as received by the third light source to determine a further value of the grouping function and assigning the third light source to the same group of light sources as the first light source and the second light source when the difference between the determined value of the grouping function and the determined further value of the grouping function is less than a predetermined threshold.

In an embodiment, at least one of the first light signal or the first sound signal may comprise information indicative of the identity of the first light source and/or information indicative of the identity of the group to which the first light source is to be assigned. Similar to encoding the information regarding emitting intensities of the signals, this kind of information may also be encoded into one or both of the first light and sound signals in any of the manners known in the art, such as e.g. using CL.

According to an aspect of the present invention, a control unit is disclosed. The control unit comprises at least a receiver (i.e., any kind of appropriate receiving means) configured for obtaining the intensity of the first light signal as received by the second light source and the intensity of the first sound signal as received by the second light source and a processing unit configured for carrying out the methods described herein. In various embodiments, the processing unit may be implemented in hardware, in software, or as a hybrid solution having both hardware and software components. Such a control unit may be implemented, for example, in a remote control for controlling the illumination system or included in another unit such as a computer, a smartphone, a switch, or a sensor device which then may be used for automatic commissioning of the illumination system.

In an embodiment, the receiver of the control unit could further be configured for obtaining an intensity of the first light signal as received by a third light source and an intensity of the first sound signal as received by the third light source, and the processing unit could further be configured for using the intensity of the first light signal as received by the third light source and the intensity of the first sound signal as received by the third light source to determine the value of the grouping function and assigning the first light source and the third light source to the same group of light sources when the determined value of the grouping function satisfies one or more pre-determined conditions. This embodiment allows multiple light sources be assigned to the same group in a centralized manner. In a further embodiment, the grouping function could be dependent on a ratio between the intensity of the first light signal as received by the third light source and the intensity of the first sound signal as received by the third light source, and a pre-determined condition would comprise the ratio being within a pre-determined range.

In an embodiment, the control unit could further include a triggering unit (i.e., any kind of appropriate triggering means) configured for providing a trigger to the first light source for emitting the first light signal and the first sound signal and/or providing a trigger to the second light source for receiving the first light and sound signals and determining the intensities of the first light and sound signals. The triggering unit enables controlled initiation of the commissioning procedure.

In an embodiment, the triggering unit may further be configured for providing a trigger to a fourth light source for emitting a fourth light signal and a fourth sound signal and/or providing a trigger to one or more of the first light source and the second light source for receiving the fourth light and sound signals and determining the intensities of the fourth light and sound signals. In this manner, the commissioning procedure for the light sources may be centrally managed by the control unit.

In a further embodiment, the trigger for the first light source ant the trigger for the fourth light source may be provided sequentially, ensuring that when one light source is emitting light and sound signals to be measured by the other light sources, the other light sources are not emitting their light and sound signals (i.e., the other light sources are "silent"), which simplifies detection and differentiation of the various signals and decoding of data which may be encoded in them.

According to another aspect of the invention, the processing unit configured for carrying out the methods described herein the methods could be included within one or more of the individual light sources within the illumination system. For example, the second light source could include a light receiver (i.e., any kind of appropriate light receiving means) configured for receiving the first light signal and determining the intensity of the received signal, a sound receiver (i.e., any kind of appropriate sound receiving means) configured for receiving the first sound signal and determining the intensity of the received signal, and the processing unit configured for performing the steps of the methods described herein.

In an embodiment, such a light source could further include a light emitter (i.e., any kind of appropriate light emitting means) and a sound emitter (i.e., any kind of appropriate sound emitting means) configured for emitting a second light signal and a second sound signal, respectively. This embodiment enables the second light source to not only perform measurements and process the light and sound signals received from other light sources, but also propagate grouping of light sources by, in turn, serving as an emitter for generating light and sound signals to be measured by other light sources.

Moreover, a computer program for carrying out the methods described herein, as well as a computer readable storage-medium (CRM) storing the computer program are provided. A computer program may, for example, be downloaded (updated) to the existing control units (e.g. to the existing optical receivers, remote controls, smartphones, or tablet computers) and light sources, or be stored upon manufacturing of these devices. Preferably, the CRM comprises a non-transitory CRM.

Hereinafter, an embodiment of the invention will be described in further detail. It should be appreciated, however, that this embodiment may not be construed as limiting the scope of protection for the present invention.

DETAILED DESCRIPTION

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
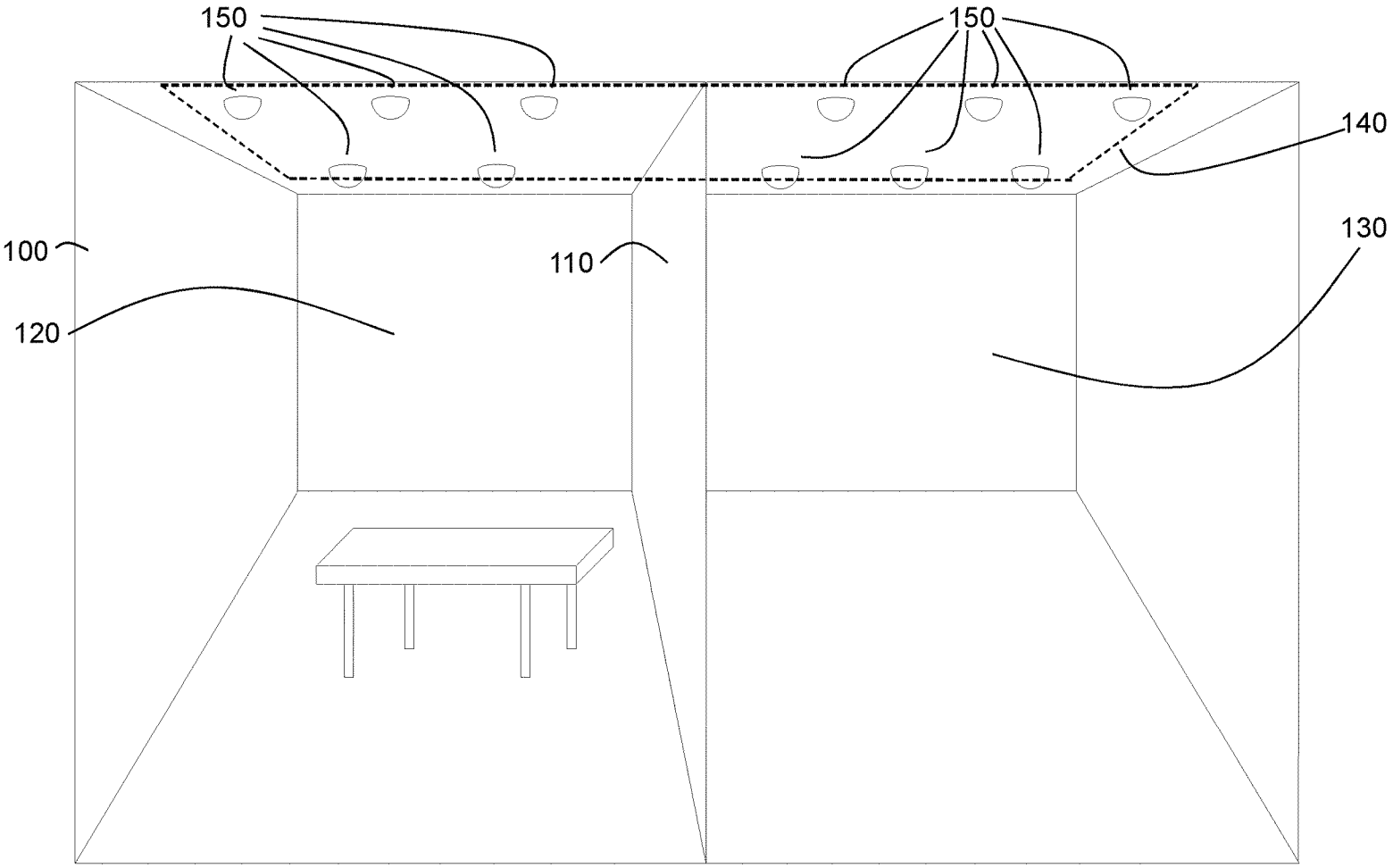
FIG. 1 is a schematic illustration of an illumination system installed in a structure according to one embodiment of the present invention.

FIG. 1 illustrates an exemplary structure 100, separated by a wall 110, e.g. a glass wall, into rooms 120 and 130. Even though the wall 110 is illustrated in FIG. 1 to be a complete wall, teachings provided herein are equally applicable to the wall 110 in a form of a wall partition (e.g. a partition starting at the floor of the structure 100 but not extending all the way up to the ceiling of the structure, or a partition where there is only a half of the complete wall in the horizontal direction) as well as to situations where there is no wall at all but the light sources in the "rooms" 120 and 130 should still be grouped into different groups because e.g. those groups of light sources are located far enough from one another. Thus, the wall 110 could be any kind of separator between the rooms or sub-section of a room, as long as such separator can result in differences of received sound and/or light intensities and/or in a difference in the measured TOF, as described in greater detail below.

In the structure 100 an illumination system 140 is installed. In the illustrative embodiment shown in FIG. 1, the illumination system 140 comprises eleven light sources 150 (five light sources—in room 120, and six light sources—in room 130). Of course, in other embodiments, the illumination system 140 could comprise any number of light sources 150 equal to or greater than two, which light sources could be placed at different places within the structure. The light sources 150 may comprise any suitable sources of light such as e.g. high/low pressure gas discharge sources, laser diodes, inorganic/organic light emitting diodes, incandescent sources, or halogen sources. During operation, the light output provided by the light sources 150 contribute to the total illumination provided by the illumination system 140 for illuminating at least parts of the structure 100.

In context of the structure of FIG. 1, one object of the present invention is to group the light sources 150 in each room in distinct groups automatically. The general idea behind the automatic grouping process can be seen as involving three basic steps: measurement, grouping, and assignment. During the measurement step, at least one light source emits a light signal and a sound signal that can be detected by other light sources. The light sources receiving the signals can determine the strength at which the signal was received (i.e., "received intensity") and can, optionally, identify the source of the signals (i.e., which light source sent the signals). Since sound signals are analyzed, glass walls or wall partitions can be detected by e.g. ultrasound by virtue of their acoustic blocking properties. In an embodiment, all of the light sources could be configured to emit a light signal and a sound signal to be measured by other light sources. Once all of the emitted light and sound signals have been detected, each light source will have a list of other light sources from which they can receive signals as well as the intensities of the received signals. The grouping step may then begin. There are various approaches that can be used to group light sources, based on the received signal strength readings. In general, by clustering the light sources according to the readings evaluated in view of certain pre-determined conditions, a picture builds up of light sources that could form part of the same group and light sources that seem to not belong to the same group. Once this picture is clear, the assignment step may take place where light sources that form a group are assigned a shared group identity by which they can be addressed by switches and other control hardware. Such a grouping process typically would take place as a part of a commissioning phase, carried out e.g. during the initial installation of the illumination system, but may also be carried out at other times, and perhaps for a smaller area, when an update is required.

Figure 3:
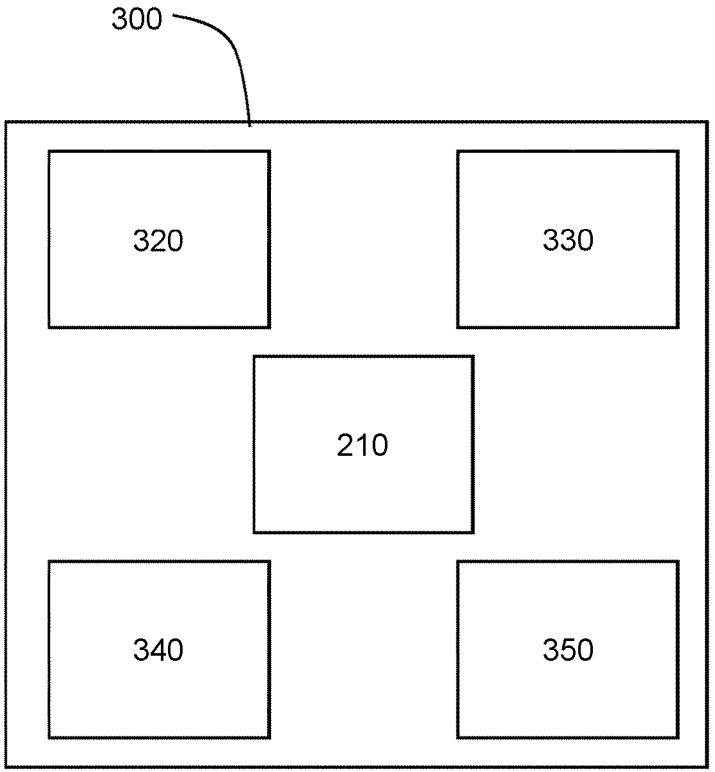
FIG. 3 is a schematic illustration of a light source, according to one embodiment of the present invention.
Figure 2:
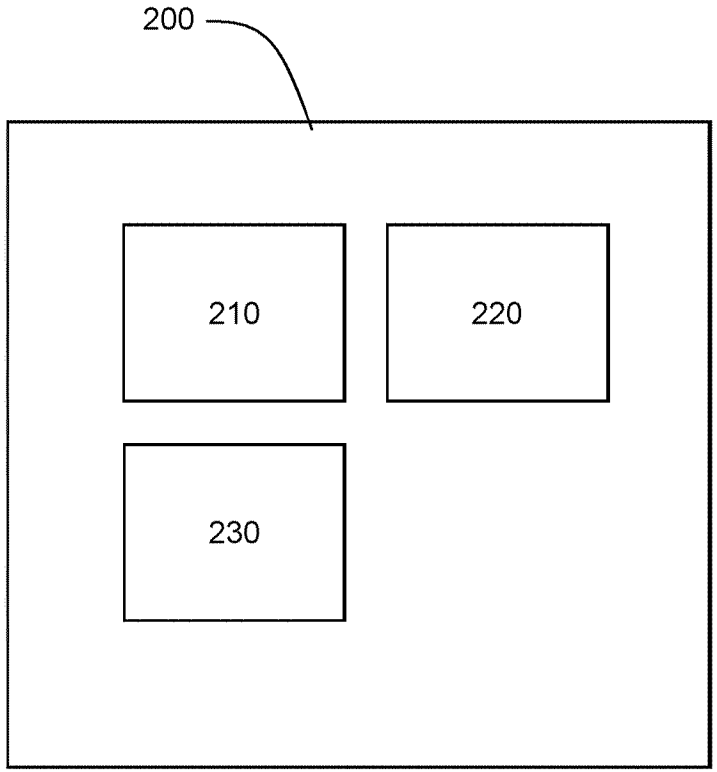
FIG. 2 is a schematic illustration of a control unit, according to one embodiment of the present invention.

The general idea of grouping described above may be implemented in various manners. The present description differentiates between so-called "centralized" and "de-centralized" implementations. In the centralized implementation, most of the functions are either controlled by or implemented in a central controller, such as e.g. a control unit 200 shown in FIG. 2, which controller can, by its nature, form a global picture of the complete illumination system. In the de-centralized implementation, the operation is performed in distributed fashion by the systems components themselves (mainly, by the light sources themselves—e.g. light sources 150 configured to be as a light source 300 shown in FIG. 3), where only a limited view of the entire illumination system is available to each of the individual components. In this implementation, the central control unit plays a limited role or no role at all. The de-centralized implementation may be particularly useful in some installations because the distributed nature of the processing means that it is highly scalable. Therefore, despite potential difficulties associated with this implementation, this may be a preferred approach in many installations in practice.

Embodiments described below will explain the grouping process for both of these implementations in greater detail, where references are made to a processing unit 210. As can be seen from comparing FIG. 2 to FIG. 3, the processing unit 210 is the common element between the centralized implementation using the control unit 200 and the de-centralized implementation using the light sources such as the light source 300. Therefore, unless explicitly stated otherwise, functions of the processing unit 210 described below are applicable to both centralized and de-centralized implementations.

For the centralized implementation, besides the processing unit 210, the control unit 200 also includes a receiver 220 configured for obtaining the intensities of the light and sound signals detected by the light sources. In an embodiment, each of the light sources 150 could be configured to provide the intensities they measured to the control unit 200 immediately after the light source measured the intensities. Alternatively, the light sources 150 could store the intensities they measure and only provide them to the control unit 200 when triggered to do so, e.g. by a triggering unit 230 which could also, optionally, be included within the control unit 200. The triggering unit 230 may also be used for providing a trigger to one or more light sources to start emitting light and sound signals to be measured by other light sources and/or for providing a trigger to the other light sources to start receiving and measuring the received light and sound signals. In this manner, the control unit 200 could control initiation of the grouping process as a part of the commissioning of the illumination system. Implementing the system such that the light sources only start receiving and measuring signals when triggered to do so allows preserving energy consumption by the light sources because their light and sound receiving interfaces may be configured to be normally in an idle mode and only wake up to make the measurements when triggered to do so. In a further embodiment, if more than one light source 150 needs to emit sound and light signals to be measured by the other light sources, the triggering unit 230 could control the sequence at which the light sources emit their signals. For example, the triggering unit 230 could provide triggers to the different light sources sequentially, to make sure that when one light source is emitting its light and sound signals, all the other light sources are not emitting similar signals but only measuring the signals emitted by the first light source. Optionally, the control unit 200 may further include a display (not shown in FIG. 2) for displaying to a user the final or intermediate results of the grouping process and for providing a user interface for controlling the light sources and other elements of the illumination system. The control unit 200 may further optionally includes a memory and a specifically designated control (RF/WiFi) unit (both not shown in FIG. 2) for controlling the light sources. Further, while the control unit 200 is illustrated as a single unit, persons skilled in the art will realize that functionality of the individual elements illustrated in FIG. 2 to be within the control unit 200 could also be distributed among several other units, where e.g. some of the processing could be performed by the individual light sources. Finally, it should be noted that, in the centralized implementation, the light sources 150 could be configured as the light source 300, the elements of which are described below, except that such light sources don't need to have the complete, or any, functionality of the processing unit 210 shown in FIG. 3 because the functionality of that unit is already included in the control unit 200. All light sources, switches, sensors, and further controllers of the illumination system 140 could be linked via network to central control unit 200 and all of these devices could be individually identifiable to control unit 200 by their system-unique addresses and by device types and subtypes, such as e.g. downlighters versus wall washers.

For the de-centralized implementation, besides the processing unit 210, the light source 300 also at least includes a light receiver 320 configured for receiving light signals from other light sources and measuring their intensities and a sound receiver 330 configured for receiving sound signals from other light sources and measuring their intensities. The light source 300 may then either be able to process the received signals itself, by the processing unit 210, or provide the values of the detected light and sound intensities to another device for processing, such as e.g. to the control unit 200. The light source 300 may further, optionally, include a light emitter 340 and a sound emitter 350. If each of the light sources 150 in the illumination system 140 includes both receivers and emitters of light and sound signals, then each of the light sources could be configured to fully participate in the grouping process not only by receiving but also by transmitting signals to be measured by other light sources. The sound receivers 330 and the sound transmitters 350 may already exist in the light sources as a part of an intelligent lighting control system that adapts automatically to the presence of people in a room, making this an attractive avenue to follow as the hardware of the existing light sources does not need to be significantly upgraded. In the de-centralized implementation, a controller similar to that of the control unit 200 may also play a role, but be limited only to its' basic functions, such as e.g. controlling overall phase of the process (i.e., providing boundaries between measurement, grouping, and assignment steps.

Figure 4:
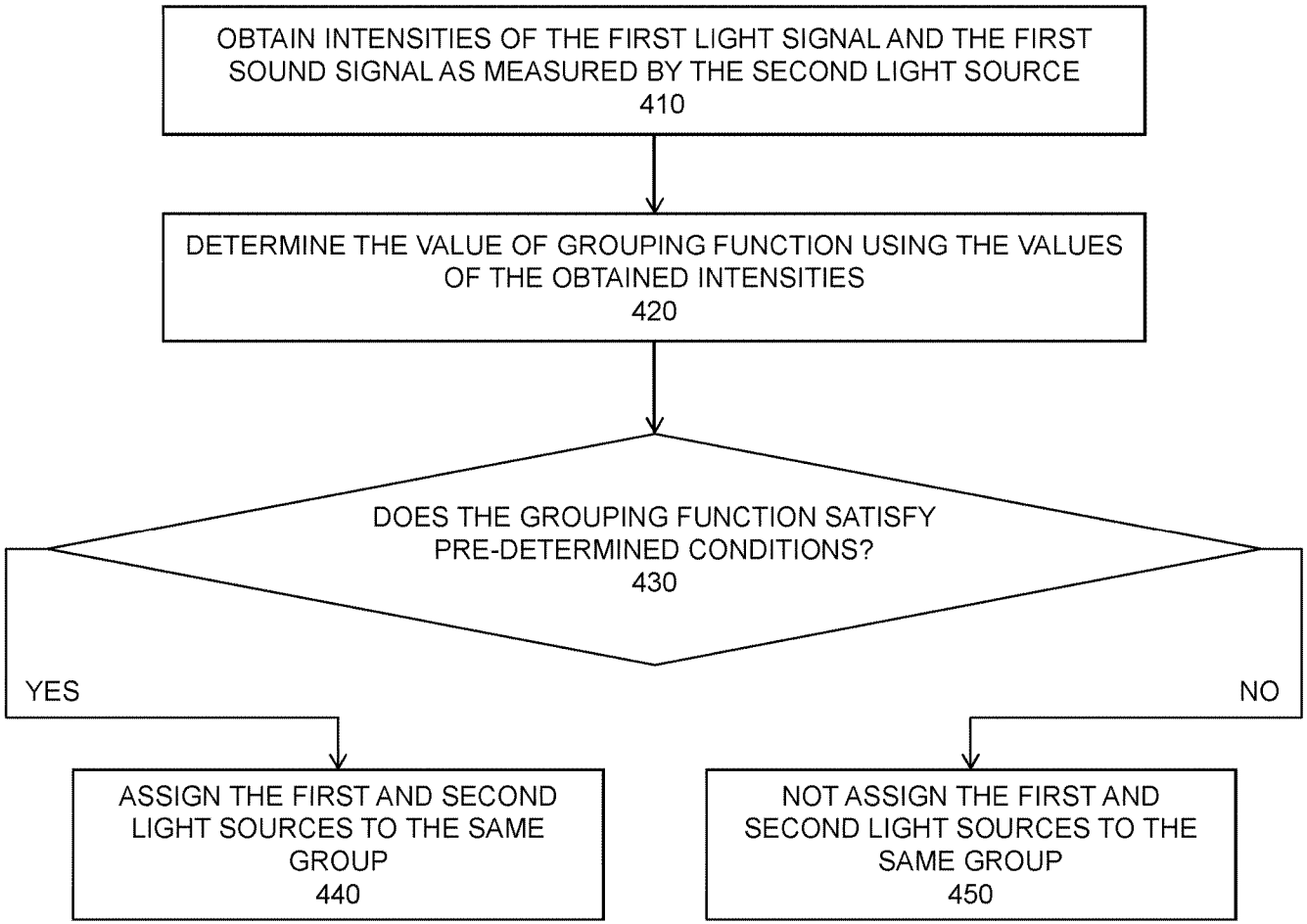
FIG. 4 is a flow diagram of method steps for automatic grouping of light sources using light and sound, according to one embodiment of the present invention.

FIG. 4 is a flow diagram of method steps for automatic grouping of light sources using light and sound, according to one embodiment of the present invention. While the method steps are described in conjunction with the elements shown in FIGS. 1-3, persons skilled in the art will recognize that any system configured to perform the method steps, in any order, is within the scope of the present invention. In particular, references are made to at least a first, second, and third light sources, each of which could be one of the light sources 150. Numeral references (i.e., first, second, third) in the description and the claims are not intended to show any sequential order or anything else besides providing the differentiation between the various light sources.

Prior to the start of the method of FIG. 4, a first light source emits a light signal and a sound signal to be measured by other light sources of the illumination system. At least one light source, a second light source, is able to detect and measure at least the intensities of both the light and the sound signal emitted by the first light source. In addition, the second light source may also be able to measure the TOF of the sound signal emitted by the first light source, as measured against the light signal emitted by the first light source. Furthermore, the second light source may be configured to measure its own light and sound signals, which may need to be provided to the processing unit 210 for calibration purposes.

In an embodiment, the light sources mounted on the ceiling may be configured to radiate the light of their light signals mostly downwards rather than sideways and the light detectors of the receiving light sources are then configured to detect the reflected light signals.

In an embodiment of a de-centralized implementation, the first light source may be a randomly chosen light source. The first light source may then be configured to begin the search procedure by broadcasting a "Start Search Of Neighboring Light sources" (SSONL) message, e.g. via the communication network of the illumination system 140, and also producing its light and sound signals to be detected by other light sources. The light sources in the proximity of the first light source may then receive the broadcasted message and measure the intensity of the received sound and light signals and the TOF of the received sound signal. If the communication network is a CL network (described in greater detail below), then the SSONL message is transmitted via CL and that message, in itself, may be the light signal emitted by the first light source for measurement by the other light sources. In other words, the second light source would then measure the intensity of the received light signal by measuring the intensity of the light encoding the SSONL message.

The method of FIG. 4 may then begin with a step 410, where the processing unit 210 obtains at least the intensities (or derivatives thereof) of the light and sound signals emitted by the first light source as measured at the second light source. Optionally, the processing unit 210 may also obtain in step 410 results of other measurements performed by the second light source, such as e.g. TOF measurements and measurements of its own light and sound signals. This information can be used by the processing unit 210 in steps 420 and 430 to e.g. advantageously eliminate ambiguities and improve the stability of an operational system.

In the de-centralized implementation where the processing unit 210 is, in this context, the processing unit within the second light source, performing step 410 may mean that the processing unit 210 receives the intensity of the light signal emitted by the first light source from the light receiver 320 and receives the intensity of the sound signal emitted by the first light source from the sound receiver 330.

In the centralized implementation where the processing unit 210 is the processing unit within the control unit 200, performing step 410 may mean that the processing unit 210 receives the intensities of the light and sound signals emitted by the first light source, as measured by the second light source, from the second light source via the receiver 220. To that end, the control unit 200 may provide a trigger to the second light source to report its measurements.

For both centralized and de-centralized implementations, it is possible that more than one light sources may happen to emit their light and sound signals at the same or overlapping time, which could provide the benefit of a faster grouping process, but then additional measures need to be taken at the receiving end so that the light and sound signals could not only still be reliably detected but also correctly differentiated. Using the term "differentiation" in this context is meant to express that a light source receiving various light and sound signals simultaneously should be able to differentiate between the individual light signals and to differentiate between the individual sound signals, as well as be able to pair each received light signal to the associated sound signal, i.e. pair the light and sound signals which were emitted by the same light source. To that end, each emitting light source could be configured to e.g. emit their light and sound signals in a particular pre-determined pattern or in a particular range of frequencies so that the receiving light sources are able to identify a pair of light and sound signals received from a single emitting light source.

Although not necessary, it may be beneficial for both the centralized and the de-centralized implementations that the emitted light and sound signals include some kind of an identification of the emitting light source and/or the device type of the emitting light source. Such identification, as well as other information which may need to be included in the light and sound signals, may be included in the signals by any type of appropriate encoding. For example, the information may be included in the light signals emitted by the light sources using CL technique where information, represented as a data signal, is embedded into the light output of a light source by modulating a drive signal to be applied to the light source in response to the data signal. There are various techniques for embedding data into the light output of a light source in this manner (e.g. pulse width modulation, amplitude modulation, etc.) which are known to people skilled in the art and, therefore, are not described here in detail. The data signal could e.g. comprise an individual identifier code of the emitting light source. As used herein, the expression "identifier of a light source" refers to any codes that allow sufficient identification of individual light sources within the illumination system. The data signal may further comprise other information regarding the emitting light source and/or the illumination system, such as e.g. a device type of the light source, current light settings of the light source (e.g. the emitting intensities of the light and/or sound signals emitted by that light source) and/or additional information regarding e.g. location of windows or projectors in a room, or any other information that may be useful to the processing unit 210 in making the decision on whether or not the first and second light sources should be assigned to the same group. In an embodiment, the data signal is embedded into the light signal of the emitting light source multiple times (e.g. as N repetitions of the data code) to ensure reliable detection of CL data at the receiving end.

Also applicable to both of the implementations is that the one or more of the emitting light sources may be configured to emit their light and sound signals multiple times, in order to ensure that the other light sources are able to reliably measure the received signals.

The method then proceeds to step 420, where the processing unit 210 determines the value of the grouping function, which value may be referred to as a Figure of Merit (FoM) for the purpose of grouping, using at least the values of the intensities of the received light and sound signals of the first light source obtained in step 410. The grouping function could be any appropriate function that takes as an input the values obtained in step 410 and allows the processing unit 210 to make a decision as to whether or not the first and second light sources should be assigned to the same group. In step 430, the processing unit 210 determines whether the grouping function identified in step 420 satisfies one or more pre-determined conditions for grouping the first and second light sources into the same group.

For example, a grouping function could be dependent on the ratio between the intensity of the light signal and the intensity of the sound signal emitted by the first light source, as measured by the second light source. The pre-determined condition for grouping the light sources could then be that the grouping function, or at least the calculated ratio, is within a certain, pre-determined, range of values with which the processing unit 210 makes a comparison. For example, if the first light source is one of the light sources 150 in the room 130, while the second light source is one of the light sources 150 in the room 120 and the wall 110 is a glass wall, then the sound signal emitted by the first light source will be noticeably attenuated, which will be reflected in the calculated ratio between the received intensities of the light and sound signals. In another examples, if, again, the first light source is one of the light sources 150 in the room 130 and the second light source is one of the light sources 150 in the room 120, but the wall 110 is an opaque wall partition that does not extend all the way up to the ceiling (not shown in FIG. 1) and the first light signal is configured to emit most of its light signal downwards, then the first light signal received by the second light source will be noticeably attenuated because a majority of it will not pass the opaque wall partition, which will, again, be reflected in the calculated ratio between the received intensities of the light and sound signals.

In another example, a grouping function could be dependent on comparing each of the received intensities with respective pre-determined threshold values, resulting in the two light sources not being grouped if either intensity is smaller than its threshold.

Of course, a grouping function could comprise components of each of these examples and be evaluated in light of multiple pre-determined conditions in order to obtain a more complete analysis of the first and second light sources with respect to one another. Furthermore, for all of these examples of the grouping function, optionally, the received intensities of the light and sound signals emitted by the first light source may be normalized prior to calculating the ratio and/or comparing the values of these intensities to some threshold value. In one embodiment, the normalization could be done with respect to the intensities of the light and sound signals emitted by and as measured by the second light source, which intensities could also be provided to the processing unit as a part of step 410. In another embodiment, the normalization could be done with respect to the emitting intensities of the light and sound signals of the first light source, which intensities could also be provided to the processing unit as a part of step 410. In yet another embodiment, the normalization could be done with respect to the TOF of the sound signal emitted by the first light source as measured by the second light source, which TOF could be provided to the processing unit as a part of step 410 as well. The operation of the grouping can be understood by considering the wider picture. In general, light and sound signals will propagate such that received signal strength varies with path length in accordance with an inverse power law. In classic free space conditions, received signal strength is proportional to $1/d^n$, where d represents the distance between transmitter and receiver and n=2. In indoor situations, the exponent n is typically modeled empirically and a higher value, e.g., 3.5 or 4, is often found to be a better match for observations.

For numerical convenience, path loss may be expressed logarithmically in decibels (dB) and, for any pair of light sources in FIG. 1, separated by distance d, general path loss equations for light and sound are the following:

$$PL(light)=UnitLoss(light)+10*n(light)*\log 10(d)+PartitionLoss(light)$$

$$PL(sound)=UnitLoss(sound)+10*n(sound)*\log 10(d)+PartitionLoss(sound)$$

Besides the term dependent on the exponent n, these equations contain two extra terms. The UnitLoss term collects together all fixed losses and all fixed terms, including receiver sensitivity, that are substantially independent of distance between the light sources and, therefore, constant across all pairings of the same type. The PartitionLoss term accounts for the extra loss that may be incurred if the signal has to cross a wall, partition or some other barrier. Where no such partition exists, or where the partition is transparent, partition loss is zero. Where a partition exists that is non-transparent to either light or sound, the corresponding partition loss could be substantially higher. Therefore, in the first instance, for each transmission mode, partition loss may be estimated in order to determine whether two light sources are in the same room or not. In the second instance, if the estimates differ across the different transmission modes, i.e., one transmission mode indicates the light sources to be in the same room while the other indicates them to be in separate rooms, the likelihood is that there exists an intentional partition that happens to be transparent to either light or sound.

As part of a grouping strategy, the received signal strength intensity (RSSI) can then be written as:

$$RSSI(light)=RadiatedPower(light)-PL(light)$$

$$RSSI(sound)=RadiatedPower(sound)-PL(sound)$$

where the term RadiatedPower represents power of the signal as emitted by the first light source. A first level of grouping may then be performed using some or all of the following axioms:

- when either or both of RSSI(light) and RSSI(sound) are too low to be recorded, the two light sources are not grouped together;
- if n(light) and n(sound) are approximately equal to each other, then, for any pair of light sources not divided by a partition, the difference between PL(light) and PL(sound) is approximately constant and the light sources may be grouped together; to that end, a light source's measurement of its own signals can provide the necessary calibration;
- when n(light) and n(sound) are known to differ, knowledge of the distance between the two light sources from ToF readings can be used to compensate; furthermore, if sufficient RSSI readings are available, n(light) and n(sound) for the particular environment can be estimated in situ;
- when the difference between PL(light) and PL(sound) deviates significantly from the constant identified earlier, the light sources may be assumed to be separated by a partition and grouped separately, where the threshold of what is considered 'significantly' may be determined in situ using a clustering algorithm and where the knowledge of the distance between the light sources may be used.

As described earlier, a grouping function that takes into account at least the measured RSSI readings, as well as possibly measured estimates for the distance between the light sources, external information on luminaire type and other pre-grouping data and so on, may be used to calculate an FoM for the link between each light source. A further level of grouping may then be applied at each light source by clustering the 'figure of merits' and thereby determining a range within which light sources are assumed to be in the same room and therefore candidates for grouping. To begin with, all light sources may be assumed to be groups of one. According to one embodiment, a possible algorithm clustering may include the steps of finding the two groups with the closest FoMs, marking these two groups as part of the same new group, and repeating these two steps until a certain termination event.

Such an algorithm will eventually group all light sources into a single group. Therefore, to prevent this, a termination event can be defined that stops the algorithm at a more suitable point. In the case of FIG. 1, the grouping function will register a distinct jump in the FoM between two groups on opposite sides of the partition compared to groups on the same side. Since the algorithm identifies groups from the closest FoM upwards, this jump means that now groups that are on opposite sides of the partition are being grouped together. This is an appropriate point to stop. In the case of FIG. 1, stopping at this point would result in having two groups, one on each side of the partition.

As a part of steps 420 and 430, the processing unit 210 may also take other, additional information, into account when making a decision on whether or not the first and second light sources should be grouped. For example, the processing unit 210 may take into consideration the nature and type of the light sources and e.g. determine that the first and second light sources do belong to the same group when the type of both light sources is a wall washer. In another example, the processing unit 210 may take into consideration other information (either received as a part of step 410 or pre-stored in the processing unit 210) such as location of windows, projectors, etc. within the structure 100. In such a case, the processing unit 210 would have information, for example, that there is a projector and a screen in the room, and would have to divide the light sources in the room into two groups, namely light sources close to the screen and light sources further away from the screen.

In an embodiment, the processing unit 210 may be configured to restrict processing of signals in steps 420 and 430 to small areas (e.g., refurbished or reconfigured areas). The processing unit 210 may, for instance, be configured to never create a group with a diameter larger than 10 meters. The distance estimation can be based on TOF between the neighbors' and triangulation.

In an embodiment, the processing unit 210 may be configured to receive user input at some point during the processing of steps 420 and 430, thus making possible manual intervention on as-needed basis. Such user input may indicate to the processing unit 210 further considerations regarding e.g. combination or splitting of groups.

In the de-centralized implementation, the processing unit 210 included within each of the light sources (e.g., the second light source) makes the decision whether or not that light source should be grouped in the group with the light source from which it received and measured light and sound signals (e.g., the first light source) substantially independently from what else may happen in the illumination system, e.g. independently from what some other light sources measured. On the other hand, the processing unit 210 included within the control unit 200 of the centralized implementation, may also take further information received from other light sources into consideration when deciding whether to group the first and second light sources together.

If the processing unit 210 determines that the calculated grouping function satisfies the one or more pre-determined conditions, then, in step 440, the processing unit 210 assigns the first and second light sources to the same group. Otherwise, the method ends in step 450 where the first and the second light sources are not assigned to the same group.

In the de-centralized implementation of the assignment step 440, the light sources 300 group themselves. To finish off the procedure, the light sources need to communicate with each other to establish a collective group identity and process requests to join the group from candidate luminaires. Such algorithms exist in MAC protocols of wireless standards such as, for example, 802.15.4. For example, by operating random back-off procedure, the first light source may issue a 'group leader' signal. In response, light sources that received that signal check their records and those that want to be part of that light source's group may issue 'join' requests, again according to a random back-off channel access strategy. The first light source may then consider these requests against its own list and either accepts the requesting light sources into its group or rejects their request.

Further in the de-centralized implementation of the assignment step 440, nearby controllers and other components of the illumination system may be configured to note new groups in their vicinity. The auto-assignment will be completed in this implementation wherever possible, while leaving the possibilities for manual assistance and fine-tuning requests on a case by case basis. The de-centralized implementation of the assignment step 440 may, additionally, implement processes for handling rejected, orphaned or otherwise incorrectly assigned light sources, processes for reassignment of group leader role to a e.g. better-located light source, and processes for relaying information between light sources at opposite ends of a long room. In an embodiment, the light sources that are selected to be the group leaders of the individual groups may be configured to issue beacons to allow network update regarding changed group assignments.

In the centralized implementation of the assignment step 440, the processing unit 210 may be configured to assign each light source a locally-unique group ID. The control unit 200 may be configured to inform other components of the illumination system, e.g. other controllers, of the groups of light sources located near to them. Similar to the de-centralized implementation, the auto-assignment will be completed wherever possible, while leaving the possibilities for manual assistance and fine-tuning requests on a case by case basis.

Embodiments of the present invention utilize the advantages of combining light with sound to help resolve ambiguous cases of the sort described. Additionally, since light and sound travel at vastly different rates, the availability of both allows the TOF of a one-way sound signal to be measured sufficiently precisely to be able to accurately determine the distance between two light sources. This information may be used to further guide the grouping process.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processing unit 210 described herein.

While the forgoing is directed to embodiments of the present invention, other and further embodiments of the invention may be devised without departing from the basic scope thereof. For example, aspects of the present invention may be implemented in hardware or software or in a combination of hardware and software. Therefore, the scope of the present invention is determined by the claims that follow.

The invention claimed is:

1. A method of grouping of light sources, the method comprising:
   - providing a first light source emitting a first light signal and a first sound signal,
   - using an intensity of the first light signal as received by a second light source and an intensity of the first sound signal as received by the second light source to determine a value of a grouping function, and
   - assigning the first light source and the second light source to the same group of light sources when the determined value of the grouping function satisfies one or more pre-determined conditions.

2. The method of claim 1, wherein the grouping function is dependent on a ratio between the intensity of the first light signal as received by the second light source and the intensity of the first sound signal as received by the second light source, and the one or more pre-determined conditions comprise a condition of the ratio being within a pre-determined range.

3. The method according to claim 1, further comprising determining a difference between the time when the first light signal is received by the second light source and the time when the first sound signal is received by the second light source.

4. The method according to claim 3, wherein the grouping function is dependent on the determined difference and the one or more pre-determined conditions comprise a condition of the determined difference being below a pre-determined value.

5. The method according to claim 3, wherein the intensity of the first light signal as received by the second light source and the intensity of the first sound signal as received by the second light source comprise values normalized to the determined difference.

6. The method according to claim 1, wherein the intensity of the first light signal as received by the second light source comprises a value normalized to an intensity of the first light signal as emitted by the first light source, and wherein the intensity of the first sound signal as received by the second light source comprises a value normalized to an intensity of the first sound signal as emitted by the first light source.

7. The method according to claim 1, wherein at least one of the first light signal or the first sound signal comprises information indicative of the identity of the first light source and/or information indicative of the identity of the group to which the first light source is to be assigned.

8. A control unit comprising:

a receiver configured for obtaining the intensity of a first light signal emitted from a first light source as received by a second light source and the intensity of a first sound signal emitted from the first light source as received by the second light source; and a processing unit configured to:

use an intensity of the first light signal as received by the second light source and an intensity of the first sound signal as received by the second light source to determine a value of a grouping function, and assign the first light source and the second light source to the same group of light sources when the determined value of the grouping function satisfies one or more pre-determined conditions.

9. The control unit according to claim 8, wherein:

the receiver is further configured for obtaining an intensity of the first light signal as received by a third light source and an intensity of the first sound signal as received by the third light source, and the processing unit is further configured for using the intensity of the first light signal as received by the third light source and the intensity of the first sound signal as received by the third light source to determine the value of the grouping function and assigning the first light source and the third light source to the same group of light sources when the determined value of the grouping function satisfies the one or more pre-determined conditions.

10. The control unit according to claim 8, further comprising a triggering unit configured for providing a trigger to the first light source for emitting the first light signal and the first sound signal and/or providing a trigger to the second light source for receiving the first light and first sound signals and determining the intensities of the first light and first sound signals.

11. The control unit according to claim 10, wherein the triggering unit is further configured for providing a trigger to a fourth light source for emitting a fourth light signal and a fourth sound signal and/or providing a trigger to one or more of the first light source and the second light source for receiving the fourth light and fourth sound signals and determining the intensities of the fourth light and fourth sound signals.

12. The control unit according to claim 11, wherein the trigger for the first light source and the trigger for the fourth light source are provided sequentially.

13. A second light source comprising:

a light receiver configured for receiving a first light signal emitted from a first light source and determining the intensity of the first light signal emitted from the first light source as received by the second light source;

a sound receiver configured for receiving a first sound signal emitted from a first light source and determining the intensity of the first sound signal emitted from the first light source as received by the second light source; and a processing unit configured to:

use an intensity of the first light signal as received by the second light source and an intensity of the first sound signal as received by the second light source to determine a value of a grouping function, and assign the first light source and the second light source to the same group of light sources when the determined value of the grouping function satisfies one or more pre-determined conditions.

14. The second light source according to claim 13, further comprising a light emitter configured for emitting a second light signal and a sound emitter configured for emitting a second sound signal.

15. A non-transitory computer-readable medium for storing a computer program configured to, when executed on a processing unit:

use an intensity of a first light signal emitted from a first light source as received by a second light source and an intensity of a first sound signal emitted from the first light source as received by the second light source to determine a value of a grouping function, and assign the first light source and the second light source to the same group of light sources when the determined value of the grouping function satisfies one or more pre-determined conditions.

* * * * *